US005319426A

United States Patent [19]

Baruch et al.

[11] Patent Number: 5,319,426

[45] Date of Patent: Jun. 7, 1994

[54] IMAGE FORMING APPARATUS HAVING IMPROVED FUSING CONSISTENCY

[75] Inventors: Susan C. Baruch, Rochester; William J. Staudenmayer, Pittsford; Steven M. Gern, Rochester, all of N.Y.

[73] Assignee: Eastman Kodak Company, Rochester, N.Y.

[21] Appl. No.: 984,659

[22] Filed: Dec. 2, 1992

[51] Int. Cl.[5] ..... G03G 15/20

[52] U.S. Cl. ..... 355/285; 219/216; 355/208; 355/289; 355/290; 355/295

[58] Field of Search ..... 355/282, 285, 289, 290, 355/295, 203, 204, 208; 219/216

[56] References Cited

U.S. PATENT DOCUMENTS

| | | | |
|---|---|---|---|
| 4,232,959 | 11/1980 | Ateya et al. | 355/290 |
| 4,905,050 | 2/1990 | Dermiggio et al. | 355/290 |
| 4,914,484 | 4/1990 | Kida | 355/290 |
| 4,934,930 | 6/1990 | Soga | 432/60 |
| 4,942,429 | 7/1990 | Kakitani | 355/208 |
| 4,961,088 | 10/1990 | Gilliland et al. | 355/206 |
| 4,972,232 | 11/1990 | Hoover et al. | 355/295 |
| 4,984,027 | 1/1991 | Dermiggio et al. | 355/290 |
| 5,001,519 | 3/1991 | Saito | 355/285 |
| 5,068,692 | 11/1991 | Menjo | 355/282 X |
| 5,073,799 | 12/1991 | Watanabe | 355/285 |
| 5,075,724 | 12/1991 | Wada et al. | 355/203 |
| 5,084,731 | 1/1992 | Baruch | 355/208 |
| 5,189,480 | 2/1993 | Hoover et al. | 355/282 |
| 5,200,785 | 4/1993 | Hoover et al. | 355/282 |

FOREIGN PATENT DOCUMENTS

| | | | |
|---|---|---|---|
| 61-99168 | 6/1986 | Japan | G03G 15/08 |

*Primary Examiner*—Matthew S. Smith
*Attorney, Agent, or Firm*—Leonard W. Treash

[57] ABSTRACT

Image forming apparatus includes a logic and control which receives an input indicative of the compliance of a fusing roller and adjusts the temperature of the fuser in response to that input. The apparatus also can receive an input indicative of the melt viscosity of one or more toners making up an image to be fused to similarly adjust the fusing temperature. Alternatively, the pressure in a fusing nip can be adjusted in response to either or both inputs. The inputs can be received in the logic and control from a fusing roller cartridge having machine readable indicating device, indicative of the compliance of the fusing roller. Similarly, the melt viscosity of the toner can be input from a machine readable indicia or the like on a toner bottle.

16 Claims, 5 Drawing Sheets

IMAGE FORMING APPARATUS HAVING IMPROVED FUSING CONSISTENCY

This invention relates to the improvement of image consistency in image forming apparatus. Although not limited thereto, it is particularly usable in improving fusing consistency in a color image forming apparatus having a roller fuser.

Different toners, for example, different color toners have different melt characteristics. These toners are often used on the same apparatus with the same fuser.

Japanese Utility Model, Laid-Open No. 61-99168, laid open Jun. 25, 1986, shows an electrophotographic apparatus having a fuser with an adjustable temperature setting mechanism. A color toner unit contains a resistor having a resistance value indicative of the color of toner in the unit. The apparatus automatically senses the resistance value for each unit in the apparatus and adjusts the temperature of the fuser to accommodate for different characteristics of different color toners.

U.S. Pat. No. 5,001,519 granted to Saito Mar. 19, 1991, also shows a fuser with a plurality of temperature settings. Movement of the particular toner station into toning position closes a switch indicative of the color of toner in the station in position. The temperature is adjusted in response to the closing of the switch according to the station that is moved into position.

The above references show a recognition that it is appropriate to adjust fusing temperature according to the color of toner being used. See also, U.S. Pat. No. 4,942,429 in which developer bias and transfer current are changed according to the color of toner.

U.S. Pat. No. 5,075,724 granted to Wada et al shows a device which accommodates for manufacturing variances in toner. Such manufacturing variances are indicated in an electrically sensible digital matrix associated with a toner bottle. The machine senses the indicator on the bottle and adjusts the machine to control toner laydown despite charge variation in the toner.

U.S. Pat. No. 4,934,930, granted to Soga Jun. 19, 1990, is illustrative of a number of references which demonstrate that the size of the nip in a roller fuser and the set temperature in the fuser can be adjusted interchangeably within limits.

U.S. Pat. No. 4,232,959, granted to Ateya et al Nov. 11, 1980, shows adjusting the pressure in a fuser to adjust the size of the fusing nip and accommodate for variations in temperature in the nip.

Japanese Patent Application No. 62-56331, Laid-Open No. 63-221373, Sep. 14, 1988, shows a fuser in which pressure is adjusted between two settings to accommodate for different thicknesses in recording paper.

U.S. Pat. No. 5,214,481, issued May 25, 1993, and U.S. Pat. No. 5,200,785, issued Apr. 6, 1993, both to Hoover et al. show a fusing roller cartridge having a fusing roller protected by a housing and an electrical connector connectable to a receiving fuser in response to insertion of the cartridge. The connector connects the fusing lamp into the fuser power source and also connects various temperature sensors into the fuser logic and control.

U.S. Pat. No. 4,961,088, granted to Gilliland et al Oct. 2, 1990, shows the use of an EEPROM on the side of a replaceable cartridge which is used for furnishing information to the apparatus, which information is updatable in the EEPROM.

U.S. Pat. No. 5,084,731, granted to Baruch Jan. 28, 1992, discloses control of a decurling device in response to an input indicative of the amount of toner on the sheet being decurled.

SUMMARY OF THE INVENTION

The viscosity of toning material affects the image clarity in producing transparencies and the gloss level of the image in the reflection copies, assuming all other variables remain the same. Knowing what the viscosity of the material is when used in the electrophotographic process, allows for determination of other process parameters for best clarity and gloss, for example, fusing temperature and fusing pressure.

The hardness of the fusing roller also impacts the clarity and gloss level of the print, largely because the hardness affects the in-track dimension (width) of the nip and, therefore, the total heat that passes to the toner.

In apparatus in which a compliant fusing roller is periodically replaced by a serviceperson, that serviceperson is generally able to adjust the pressure in a nip between the fusing roller and a pressure roller to provide appropriate fusing conditions, for example, appropriate nip width. One reason this adjustment is necessary is that fusing rollers cannot be made to exactly the same compliance from roller to roller or batch of rollers to batch of rollers.

It is an object of the invention to improve the consistency of fusing in apparatus using a compliant roller while eliminating or reducing the need for serviceperson installation and pressure adjustment.

This and other objects are accomplished in an image forming apparatus which includes means for forming a toner image on a receiving sheet and heated roller fusing means for fusing the toner image to the receiving sheet. The fuser includes first and second pressure members positioned to form a pressure nip. At least one of the pressure members is a roller having an amount of compliance which varies from roller to roller, thereby causing some variance in the length or in-track dimension of the nip. The fuser also includes a controllable means for heating at least one of the pressure members to heat the pressure nip, and an adjustable means for controlling the heating means to control the temperature in the nip. A logic and control includes means for receiving an input indicative of the compliance of the roller and means for adjusting the controlling means in response to the input.

According to a preferred embodiment, the compliant roller is a fusing roller which is supplied in the apparatus in a fusing roller unit, which unit includes an automatically sensible means for indicating the compliance of the fusing roller contained in the unit. A sensing means associated with receiving apparatus for the unit cooperates with the sensible means to adjust the temperature of the fuser according to an indicated compliance of the fusing roller received in the apparatus.

With this structure, the fusing roller can be replaced in the apparatus by an untrained operator, and the apparatus will be automatically adjusted for compliance variations in the fusing roller.

It is, thus, also an object of the invention to provide a fusing roller unit which can be input into such a receiving image forming apparatus.

This latter object is accomplished by a fusing roller unit including a fusing roller having a compliance which varies from roller to roller within tolerances, and automatically sensible means for indicating the compliance of the roller in that unit.

According to a further preferred embodiment of the invention, variations from batch to batch in melt viscosity of toner are automatically accommodated by sensing an indicator associated with a received toner bottle, indicative of the melt viscosity of toner in the bottle received. Adjustment of the fusing temperature is made according to the input from the toner bottle, which adjustment can be made individually or in combination with the adjustment from the fusing roller unit.

DESCRIPTION OF THE PREFERRED EMBODIMENTS

Figure 1:
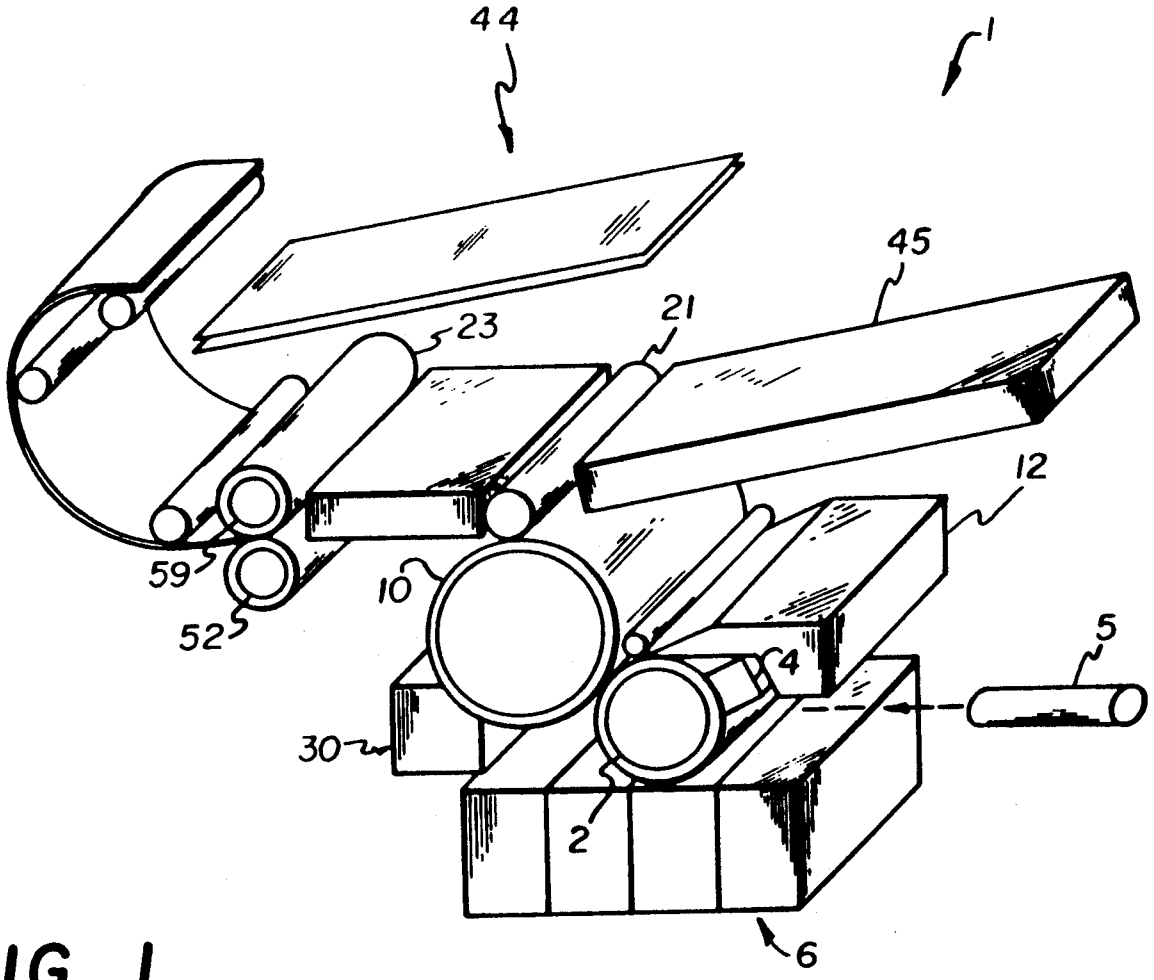
FIG. 1 is a schematic of an image forming apparatus in which the invention is usable.

FIG. 1 shows an image forming apparatus 1 in which the invention can be used. According to FIG. 1, an image member, for example, a photoconductive drum 2 is rotated past a series of stations including a charging station 4 which creates a uniform electrostatic charge on the periphery of drum 2. An exposing device, for example, laser 5, imagewise exposes drum 2 to create a series of electrostatic images. Each of the images is toned by a toner of a different color by development device 6 which contains four toning stations which are moved through a toning position in operative relation with drum 2 to create a series of single-color toner images. The single-color toner images are transferred in registration to the peripheral surface of an intermediate transfer drum 10 to create a multicolor image. The multicolor image is transferred in a single step to a receiving sheet fed from a receiving sheet supply 45 through a transfer station 21. The receiving sheet with the multicolor image on one side is fed to a fuser 23 having a fusing nip formed by a fusing roller 52 and a pressure roller 59. The fusing roller 52 contacts the multicolor image to fix it to the receiving sheet. The receiving sheet is then fed to an output hopper 44.

Figure 3:
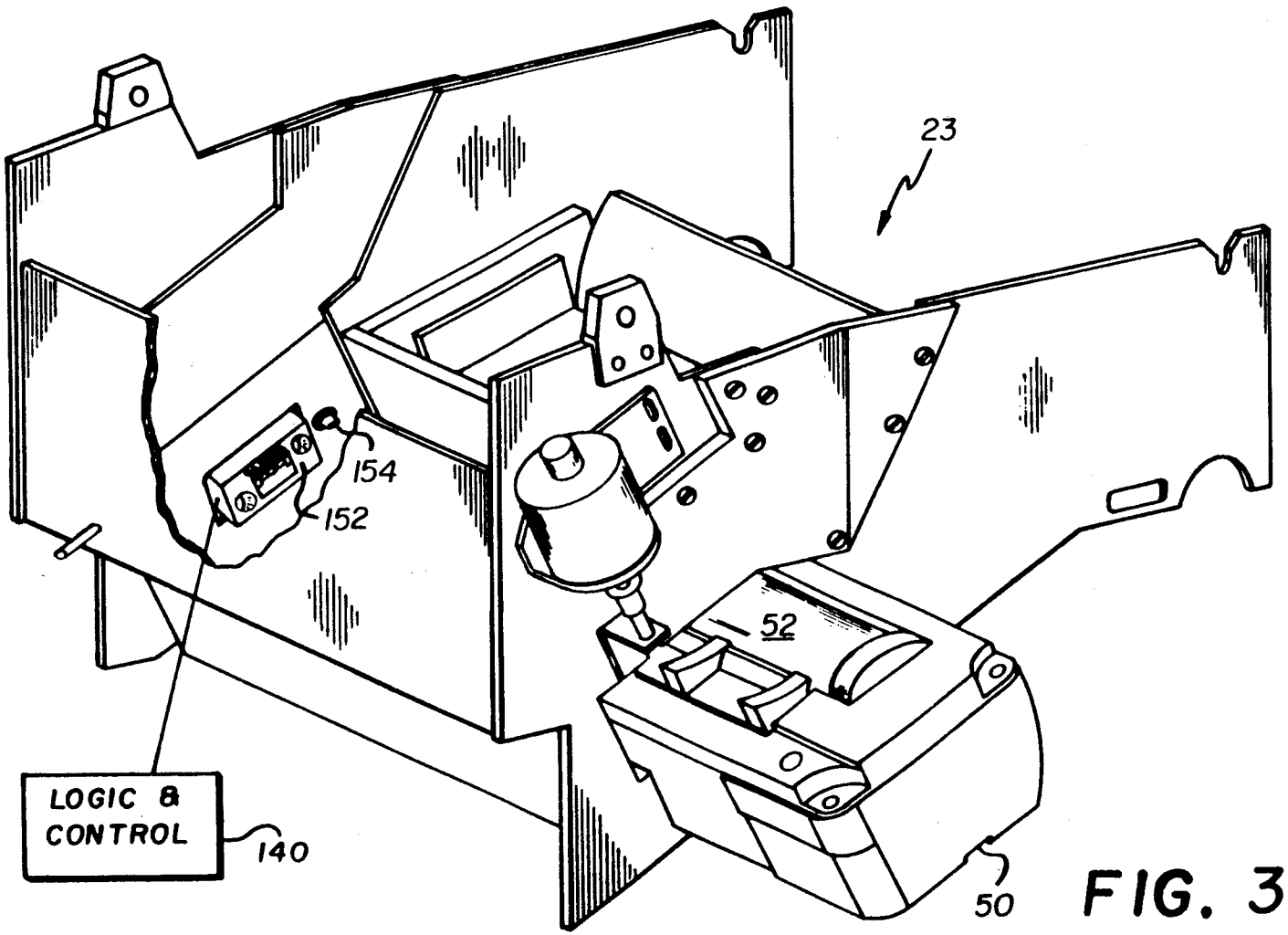
FIG. 3 is a perspective view with portions broken away of a fusing roller portion of a fuser.
Figure 4:
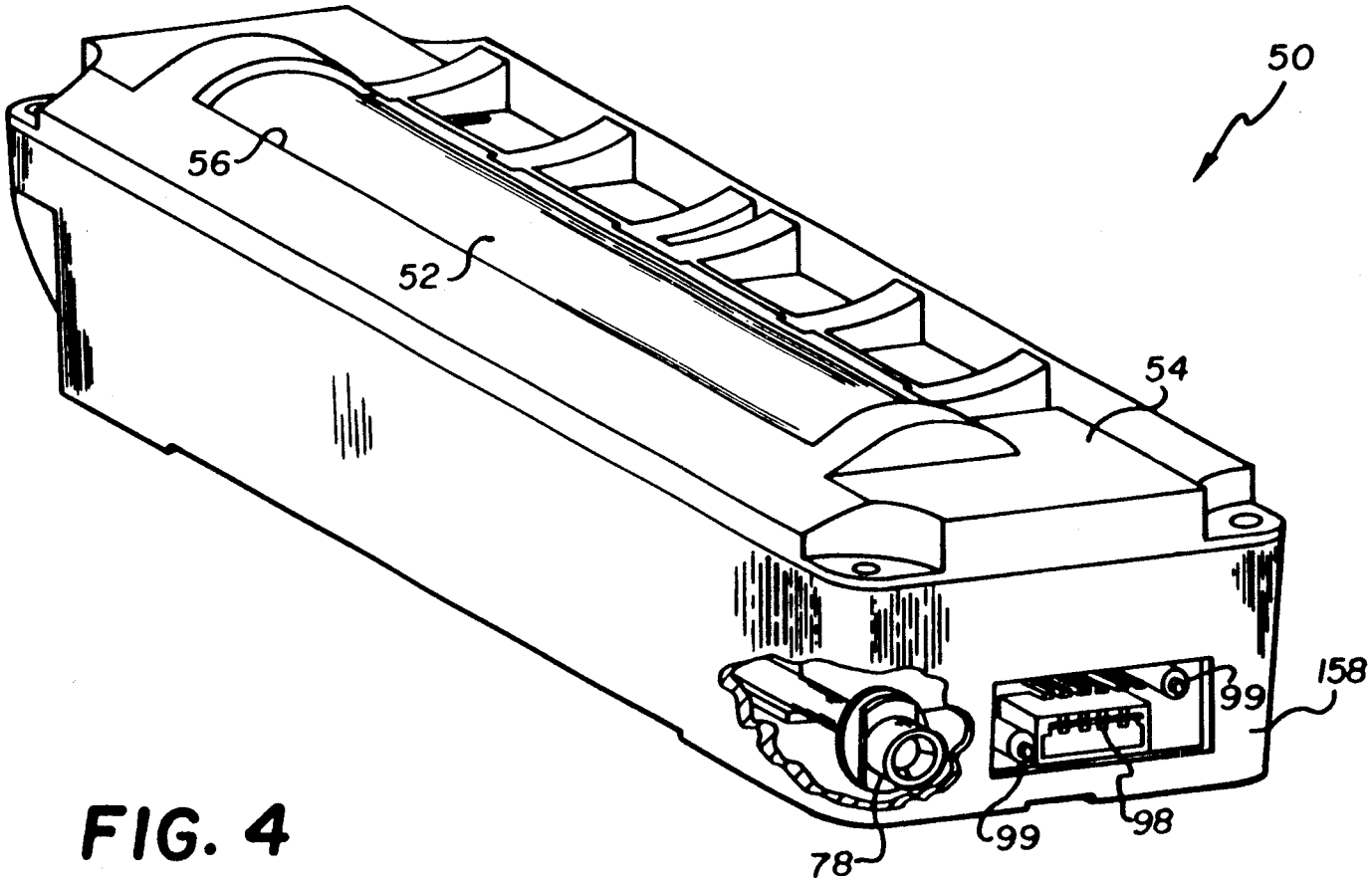
FIG. 4 is a perspective view of a fusing roller cartridge.

The image forming apparatus 1 is designed for customer replacement of all supply items that ordinarily are used up or wear out during the life of the apparatus. Included among such items is the toner and the fusing roller. The toner is conventionally supplied in bottles and, at any one time, can include four different bottles, each containing a different color toner. Alternatively, a single bottle with four chambers containing two different toners or two bottles, one with one chamber for black toner and the other with three chambers for the non-black colors, can be used. The fusing roller can be supplied in a cartridge, which cartridge is shown in FIGS. 3 and 4 and will be discussed more thoroughly below.

The fusing quality is dependent upon the total amount of heat passed to the toner image. This is dependent, in turn, upon not only the temperature of the fusing roller itself but on the in-track dimension, herein sometimes called "width" of the nip. Assuming fixed roller geometry, nip width, in turn, is a function of the force applied forcing the rollers together and of the compliance of the rollers.

If the fusing roller is replaced periodically, and if the compliance varies from fusing roller to fusing roller, then the nip length will vary unless an adjustment in the force between the rollers is made. If a trained serviceperson is replacing the fusing roller, that adjustment can generally be made in a sophisticated copier. However, if the fusing roller is replaced by an untrained operator by insertion of a cartridge, such an adjustment cannot ordinarily be made.

Figure 2:
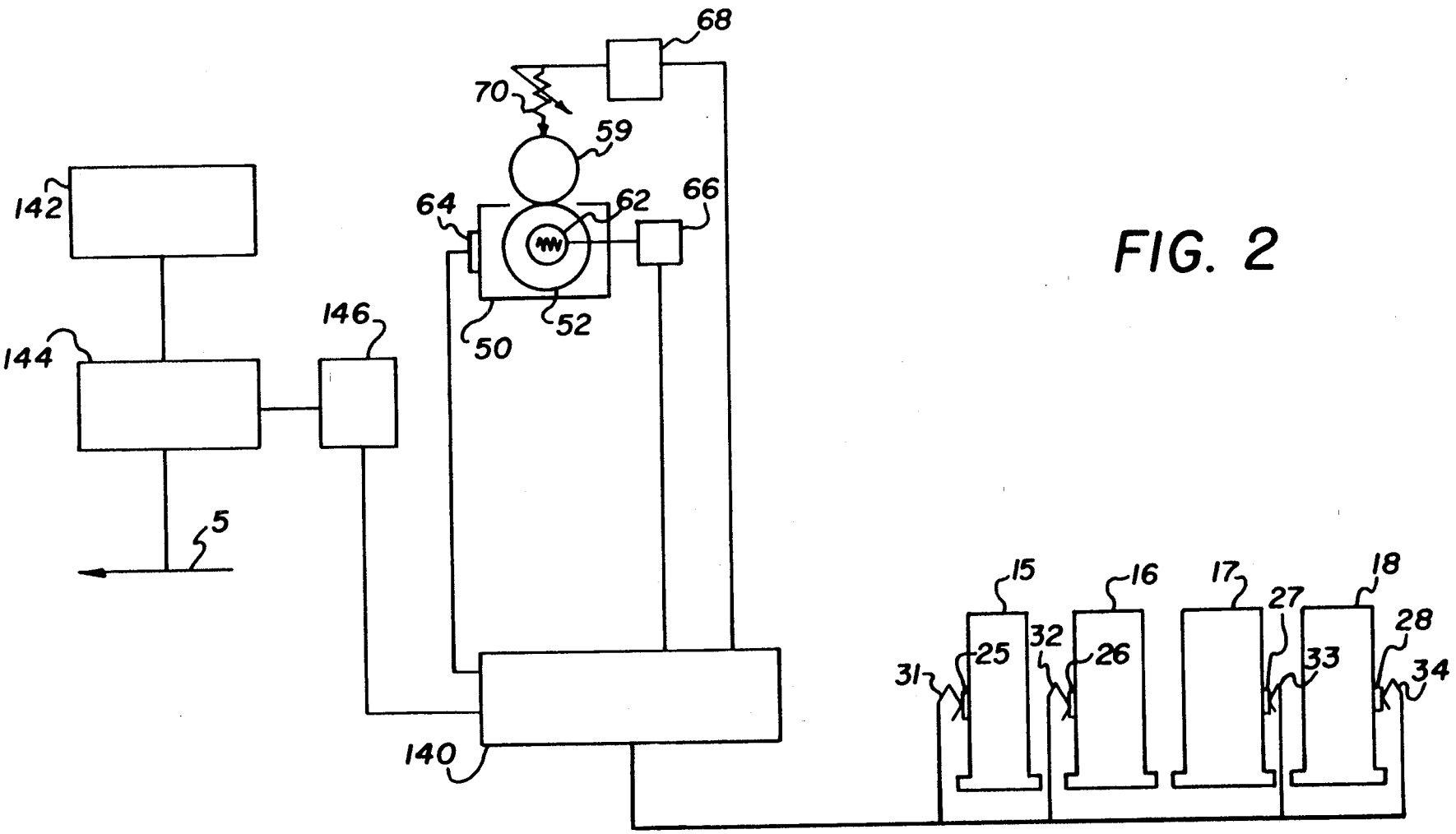
FIG. 2 is a schematic illustrating the electrical cooperation between logic and control, fuser and toner bottle receiving portions of an image forming apparatus.

A solution to this problem is illustrated in FIG. 2. According to FIG. 2, the fusing roller 52 includes a heating lamp 62 which is heated by an appropriate adjustable power source 66. The fusing roller 52 is contained in a cartridge 50 which is inserted by the operator into the apparatus. The cartridge 50 includes a fusing roller indicating means 64 which is sensed by a logic and control 140 of the receiving apparatus. Fusing roller indicating means 64 includes a sensible mechanism indicating the compliance of fusing roller 52. More specifically, when fusing roller 52 is assembled into cartridge 50, the compliance of fusing roller 52 is measured and noted in an indicator means 64, which indicator means provides an input for the receiving apparatus logic and control 140. In response to the input from indicator means 64, logic and control 140 can adjust the fuser for the compliance of fusing roller 52 by adjusting the appropriate setpoints for power source 66, thereby adjusting the temperature or duty cycle of lamp 62 and of fusing roller 52. Thus, if fusing roller 52 is somewhat more compliant than nominal but still within tolerances, appropriate indication in indicator means 64 will cause power source 66 to use somewhat lower setpoint in controlling the temperature of fusing roller 62. The lower temperature compensates for the wider nip caused by the greater compliance.

Alternatively, or in combination with a temperature adjustment, the pressure between the rollers 52 and 59 can also be adjusted. That is, an adjustable pressure-applying means 70 is adjusted by a pressure control means 68, again in response to an input to logic and control 140 of a particular indication of compliance of fusing roller 52. If fusing roller 52, as in the previous example, is somewhat more compliant than normal but still within tolerances, the pressure applied by pressure-applying means 70 is reduced slightly to provide approximately the same width of nip as with a nominal compliance in fusing roller 52.

The same adjustments can be used to accommodate for manufacturing variances in toners. Still referring to FIG. 2, black, cyan, magenta and yellow toners are supplied in toner bottles 15, 16, 17 and 18. Each of the toner bottles has a toner bottle indicating means 25, 26, 27 and 28, respectively, containing information capable of being sensed, which information is indicative of the melt viscosity of the toner in its respective bottle. Receiving contacts 31, 32, 33 and 34 contact indicating means 25, 26, 27 and 28, respectively, to provide the melt viscosity information contained therein as inputs to logic and control 140. This information can then be used to control either or both of the temperature of fusing roller 52 or the pressure applied between the rollers 52 and 59.

Use of the melt viscosity information is somewhat more complicated than use of the compliance of the fusing roller information. Logic and control 140 can assume that an average color print is being made and utilize a lookup table in which all four melt viscosities are combined in an average percentage in each print. Using this approach, the same fusing roller temperature or pressure would be used for all prints.

However, FIG. 2 illustrates a more sophisticated control. A computer 142 (or a color scanner, a memory or the like) provides an electrical signal to a raster image processor 144 with sufficient information for raster image processor 144 to contol laser 5 in creating the series of electrostatic images that ultimately define the different color toner images. A pixel counter 146 counts the number of pixels to determine the color content of each image and provides that information to logic and control 140. The look-up table in logic and control 140 can now provide a more precise temperature setpoint for each receiving sheet. Fusing roller temperature does not adjust immediately. However, in four-color printing, there is sufficient time between prints to do minor adjustments. This particular approach is especially useable if a large number of consecutive prints are made using a particular balance of colors or one single color. It is obviously less effective if consecutive prints are substantially different because of the time for temperature adjustment of the fusing roller. Pressure adjustment, on the other hand, can be done instantaneously.

The look-up table for the approach just described is quite extensive, requiring four inputs from the toner bottles nd four from the pixel counter. However, compromises to this approach greatly simplify the look-up tables. A much less complex approach is to average the four inputs from the toner bottles and adjust the setpoints to a position that remains unchanged until one of the bottles is changed.

Alternatively, averaging of the melt viscosities of the toners can be accomplished in another way. For example, it is known to package three or four color toners together for replacement at a single time in a printer. The toner bottles can be separate; they may be connected by a fastening device; or they can comprise a single bottle with three or four chambers for the different color toners. With this approach to supplying toner, a single indicator for the three non-black color toners or for all four toners can provide the melt viscosity input to obtain the ideal setpoint for that toner combination. This would simplify both the logic and control and the sensing mechanism necessary, since only one or two sensors would be required (depending on whether the black is sensed separately or not).

The fusing roller 52 includes a 1 ½ inch aluminum core covered with 100 mils of conductive silicone rubber which is co vered with approximately 1 mil of Viton as an oil barrier layer and then covered with about 2 mils of Silastic E as a toner release layer. Total compliance of the roller, even under relatively close manufacturing conditions can vary such that roller hardness can range from 64 to 74 Shore Å. This amount of compliance variation can be accommodated in a typical fusing arrangement (with a hard pressure roller 59) by adjusting the roller temperature by approximately 20° F. The actual temperatures would depend, of course, on the melt viscosities of the toners being used. For example, a typical polyester cyan toner has a melt viscosity of 9000 poise at 375° F. To accommodate for a hardness variation ranging between 64 and 74 Shore Å, temperature for such a toner is adjusted between 365° F. and 385° F.

Combining the melt viscosity variations with the variations in compliance of the roller is somewhat more complicated. If the average melt viscosity can vary from 6000 to 13000 poise at 375° F., then a similar adjustment to the fusing temperature of 30° F. will improve the consistency of the fusing for such variations in melt viscosity. Accommodating both variations in melt viscosity and roller complicance requires adding the adjustment required for each. The two effects could cancel each other or result in a maximum temperature adjustment ranging from 350° F. to 400° F.

The above example is for known materials and manufacturing processes. However, each different material and each manufacturing process will affect the desired ranges. These are easily determined by a person skilled in the art. Note that this invention allows the use of manufacturing processes that are not as tightly controlled as would be necessary with single temperature or pressure setpoints, as well as improving the consistency of performance even with more closely controlled manufacturing processes.

The indicating means 25, 26, 27 and 28 on the toner bottles can be constructed according to a number of prior art designs. See, for example, U.S. Pat. No. 5,075,724; Japanese Utility Model 61-99168 and U.S. Pat. No. 4,961,088. Other schemes include a single electrical resistance whose value varies according to the melt viscosity variation. That single resistance is sensed by incorporating it into the receiving apparatus circuitry, as will be explained in more detail with respect to FIG. 5.

Because the preferred fusing roller cartridge 50 requires electrical connection for both temperature sensing and fusing lamp control, incorporation of an indicating means is more conveniently accomplished than with the toner bottle. It is preferably incorporated into the circuitry of the cartridge itself.

Referring to FIG. 3, a portion of fuser 23 is shown with a fusing roller cartridge 50 partially inserted. The fusing roller cartridge itself is shown in FIG. 4. The cartridge 50 includes a fusing roller 52 which is accessible through an access opening 56 in the receiving apparatus through which it contacts a pressure roller 59 (FIGS. 1 and 2). The fusing roller is inserted in the apparatus with a leading end 158 first generally as shown in FIG. 3. As seen in FIG. 4, the leading end includes an electrical connector 98 with connector guide pins 99 and also an oil connecting valve 78. The fusing roller 52 itself is protected by a housing 54, as are the connectors and the oil-supplying mechanism. The fusing roller 52 also includes a lamp, not shown in FIGS. 3 and 4 but shown schematically in FIG. 2. The lamp is connected to power source 66 in the receiving apparatus through connectors 98. The cartridge 50 also includes temperature sensing devices, including a maximum temperature safety cutoff and a fusing roller temperature sensor. These sensors are connected to the apparatus through connecting valve 78 and, when connected, operate as an important part of the fuser control circuitry. Cartridge 50 also includes a resistance 92 (FIG. 5) which is indicative of the compliance of the fusing roller, as described above and, thus, is the fusing roller indication means 64. It is connected into the circuitry (shown in FIG. 5) associated with logic and control 140, also through electrical connector 98.

A similar connection could be made for the toner bottles 15, 16, 17 and 18. However, since the indicating means is the only electrical connection associated with the bottles, a connector such as connector 98 on the fuser cartridge is more sophisticated than is necessary. Accordingly, a preferred and less costly spring urged connector is shown schematically in FIG. 2 to provide the melt viscosity input from indicating means 25, 26, 27 and 28 to the logic and control 140.

Figure 5:
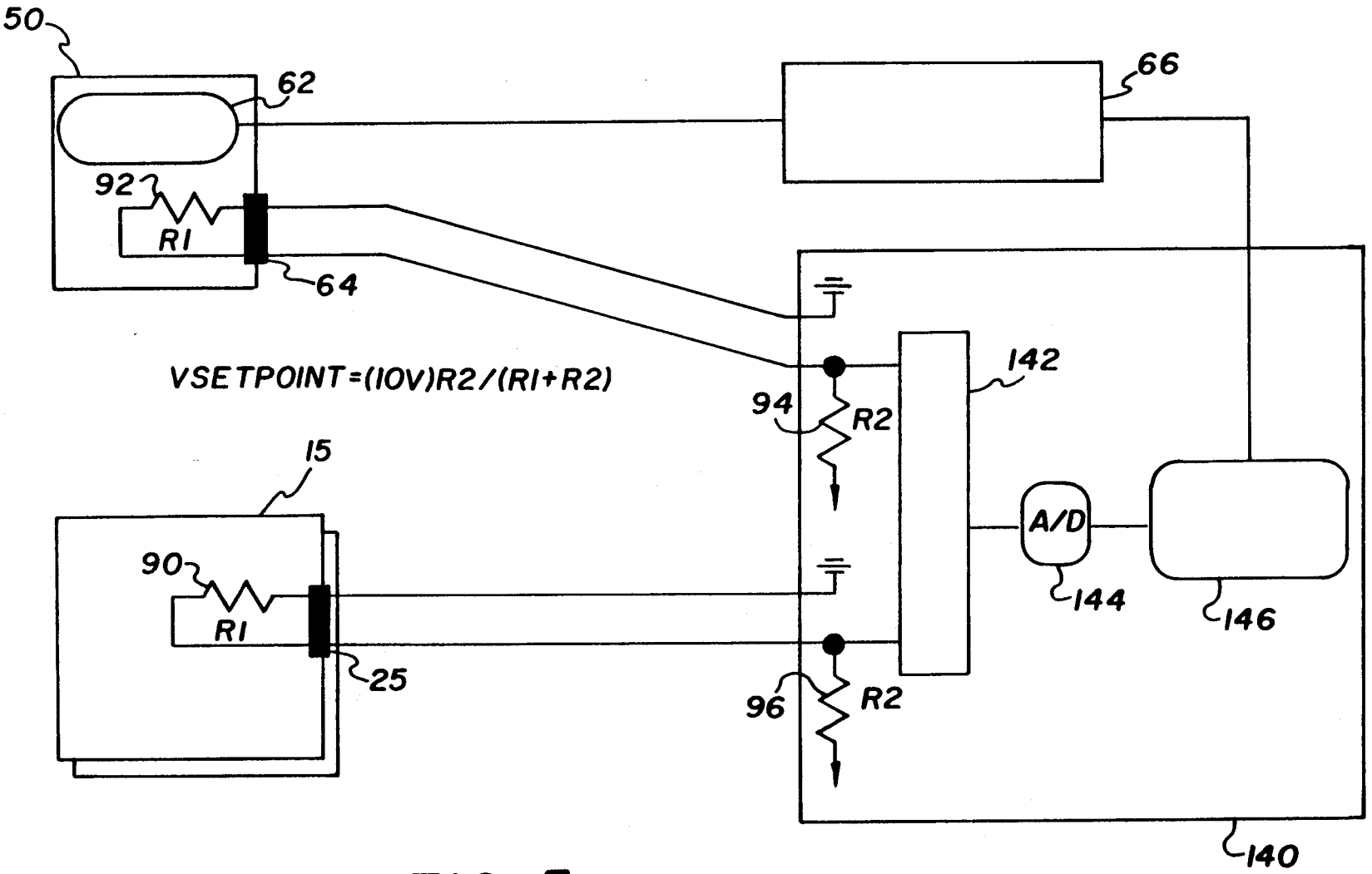
FIG. 5 is a circuit diagram illustrating a fusing temperature control circuit.

FIG. 5 illustrates a circuitry usable in incorporating both the melt viscosity of the toner and the compliance of the fusing roller into the setpoint for the fuser lamp 62. Referring to FIG. 5, a resistance 90 indicative of the melt viscosity of the toner in bottle 15 is connected into a circuitry for logic and control 140. Similarly, resistance 92 in fusing roller cartridge 50, which resistance 92 is indicative of the compliance of fusing roller 52 is also incorporated into the circuitry associated with logic and control 140. Logic and control 140 compares the resistances 90 and 92 with nominal resistances 96 and 94, respectively, and feeds the difference into a multiplexer 142. After the multiplexed signal is passed through an analog-to-digital converter 144, it is fed to a microprocessor 146. The microprocessor 146 contains suitable programming, for example, a lookup table with various combinations of melt viscosity and compliance, to provide the ideal setpoint for fuser lamp 62, which setpoint is used to adjust the operation of power supply 66, in response to the temperature sensor in fusing roller cartridge 50.

Although variations in compliance and melt viscosity should be relatively small and, therefore, handleable in this way, it is within the scope of the invention, for a combination of compliance and melt viscosity in a single direction to be outside the range of the apparatus. For example, if the toner is at the lowest melt viscosity permitted and the fusing roller received in the apparatus is at the highest permissible compliance, the desired temperature setpoint arrived with these two conditions may be below that which will provide acceptable results. In this case, a signal to the operator may be appropriate. Obviously, if a pressure adjustment is also possible, a reduction in the force applying the pressure may be able to compensate for this unfortuitous condition.

Utilizing this approach, print quality improvements in clarity and gloss levels can be optimized even though manufacturing material parameters vary. Note that the same logic and control could receive inputs made by an operator who puts the same inputs into the logic and control as a result of reading directions on the cartridge or a container for the cartridge. For example, in response to instructions on the fusing roller cartridge, a fusing roller cartridge setpoint knob on the apparatus can be adjusted to a particular number which would, in a less convenient manner, accomplish the same result as the automatic sensing of the resistance in the fusing cartridge. Obviously, in simple operator serviced equipment, the automatic machine readable input is preferred.

Obviously, other approaches than that shown in FIG. 5 to providing automatic input from a cartridge to the apparatus can be used. Many of these approaches are well known in the art and, in fact, are documented in the prior art cited earlier in this specification. For example, a relatively sophisticated approach would be to use a programmable EEPROM in the cartridge which is programmed in the factory with the compliance or melt viscosity data. A less high tech, but perhaps less expensive approach, would be to use variably placed cartridge notches which are used to close one or more of a number of switches in the apparatus to input the same data. Both of these approaches to inputting data from a consumable container are well known in the art.

We claim:

1. Image forming apparatus comprising:
means for forming a toner image on a receiving sheet,
means for fusing the toner image to the receiving sheet, said fusing means including,
first and second pressure members positioned to form a pressure nip, at least one of said pressure members being a replaceable roller having an amount of compliance which varies, from roller to roller, within a tolerance range, to cause some variance in the size of the nip,
controllable means for heating at least one of said pressure members, and
adjustable means for controlling the controllable means to control the temperature in the nip, and
logic and control means including means for receiving an input indicative of the compliance of the replaceable roller and means for adjusting the means in response to said input.

2. Image forming apparatus according to claim 1 wherein said roller is a fusing roller which directly contacts the toner image side of the receiving sheet and the other pressure member is a pressure roller which contacts the side of the receiving sheet opposite the toner image.

3. Image forming apparatus according to claim 2 further including a fusing roller cartridge containing said fusing roller, said cartridge including indicating means containing a machine sensible indication of the compliance of the fusing roller and said apparatus further includes means for sensing said indicating means and providing said input to said logic and control means in response thereto.

4. Image forming apparatus according to claim 3 wherein said fusing roller cartridge includes a fusing roller having an axis of rotation and said fusing roller cartridge is insertable in said image forming apparatus by movement parallel to the axis of rotation during which movement the cartridge has a leading end, said cartridge further including electrical connecting means on said leading end positioned to create electrical connection with a receiving electrical connecting means in the image forming apparatus in response to said movement and said sensible indicating means is an electrically sensible indicating means which is connected to said logic and control through said electrical connections.

5. Image forming apparatus comprising:
means for forming a toner image on a receiving sheet,
means for fusing the toner image to the receiving sheet, said fusing means including,
a pressure roller,
a fusing roller having an amount of compliance which varies, from roller to roller, within tolerances,
means for heating at least one of said rollers, and
means for applying a force urging the rollers together to form a heated pressure nip for receiving the receiving sheet,
logic and control means including,
means for receiving an input indicative of the compliance of the fusing roller, and
means for controlling the total heat imparted to a receiving sheet in said nip in response to said input.

6. Image forming apparatus according to claim 5 wherein said means for controlling includes means for adjusting the force applied, urging said rollers together to form said nip.

7. Image forming apparatus according to claim 5 wherein said means for controlling, includes means for adjusting the temperature of said nip.

8. Image forming apparatus comprising:

means for forming a toner image on a receiving sheet, said means including means for holding or receiving a supply of dry toner having a nominal melt viscosity at a given temperature, which melt viscosity can vary within tolerances from batch to batch, means for fusing the toner image to the receiving sheet, said fusing means including, first and second pressure members positioned to form a pressure nip, at least one of said pressure members being a roller having an amount of compliance which varies, from roller to roller, within tolerances, to cause some variance in the width of said nip, means for heating at least one of said pressure members to heat said pressure nip, and adjustable means for controlling the heat imparted in said nip to a toner image on a receiving sheet, logic and control means including, means for receiving a first input indicative of the melt viscosity of toner in the toner receiving or holding means, means for receiving a second input indicative of the compliance of the roller, and means for adjusting the controlling means in response to both of said first and second inputs.

9. Image forming appafratus according to claim 8 wherein said means for controlling includes means for adjusting the heating means to maintain the pressure members at a predetermined temperature which temperature is controlled according to said inputs.

10. Image forming apparatus comprising:

means for forming a toner image on a receiving sheet, said means including means for holding or receiving a supply of dry toner having a nominal melt viscosity at a given temperature, which melt viscosity can vary within tolerances from batch to batch, means for fusing the toner image to the receiving sheet, said fusing means including, first and second pressure members positioned to form a pressure nip, controllable means for heating at least one of said pressure members to heat said pressure nip, and adjustable means for controlling the controllable means to control the temperature in said nip, logic and control means including means for receiving an input indicative of the melt viscosity of toner in the toner receiving or holding means, and means for adjusting the adjustable means in response to said inputs to vary the temperature in the nip according to the melt viscosity of the toner.

11. Image forming apparatus according to claim 10 wherein said means for forming a toner image includes means for forming a multicolor image and said holding or receiving means includes means for holding or receiving ong or more containerw containing at least two toners of different melt viscosities and said logic and control includes means for receiving inputs indicative of the melt viscosity of each of the at least two toners.

12. Image forming apoparatus according to claim 11 wherein said logic and control includes means for algorithmically combining said inputs to derive an output indicative of the desired temperature in the nip.

13. Image forming apparatus according to claim 11 wherein said logic control includes means for receiving input indicative of a relative color makeup of said multicolor image and said temperature is controlled according to each of said inputs of melt viscosity and each of said inputs of color makeup.

14. A fusing roller unit comprising:

a fusing roller which has been manufactured in a process that produces rollers having a compliance which varies from roller to roller within tolerances, support means for holding the fusing roller for insertion in an image forming apparatus as a unit, and automatically sensible means coupled to said support means and coupleable with a receiving image forming apparatus for indicating the compliance of said roller.

15. A fusing roller cartridge comprising:

a housing, a fusing rollerr mounted for rotation about an axis of rotation within said housing, means defining an access opining for access to said fusing roller, said fusing roller being mountable in a receiving apparatus by movement generally parallel to said axis of rotation, during which movement said fusing roller cartridge has a leading end, electrical connecting means associated with the leading end of said cartridge, and electrically sensible means contactable through said electrical connecting means for indicating compliance of the fusing roller in said cartrideg.

16. A fusing roller cartridge according to claim 15 wherein said electrically sensible means is a resistance having a value indicative of the compliance of the fusing roller.

* * * * *

UNITED STATES PATENT AND TRADEMARK OFFICE

CERTIFICATE OF CORRECTION

PATENT NO. : 5,319,426

DATED : June 7, 1994

INVENTOR(S) : Steven M. Gern, et. al.

It is certified that error appears in the above-indentified patent and that said Letters Patent is hereby corrected as shown below:

Column 8, line 21, before "means" insert -- adjustable--.

Signed and Sealed this

Thirtieth Day of August, 1994

*Attest:*

*Attesting Officer*

Bruce Lehman

BRUCE LEHMAN

*Commissioner of Patents and Trademarks*